US009586075B2

(12) United States Patent
Goodson

(10) Patent No.: US 9,586,075 B2
(45) Date of Patent: Mar. 7, 2017

(54) EXERCISE DEVICE FOR PERFORMING DIPS

(71) Applicant: Marc Goodson, Galax, VA (US)

(72) Inventor: Marc Goodson, Galax, VA (US)

( * ) Notice: Subject to any disclaimer, the term of this patent is extended or adjusted under 35 U.S.C. 154(b) by 0 days.

(21) Appl. No.: 14/308,831

(22) Filed: Jun. 19, 2014

(65) Prior Publication Data

US 2015/0065321 A1 Mar. 5, 2015

Related U.S. Application Data

(60) Provisional application No. 61/873,875, filed on Sep. 5, 2013.

(51) Int. Cl.

| | |
|---|---|
| ***A63B 26/00*** | (2006.01) |
| ***A63B 21/00*** | (2006.01) |
| ***A63B 23/12*** | (2006.01) |
| ***A63B 21/068*** | (2006.01) |

(52) U.S. Cl.

CPC ..... *A63B 21/00047* (2013.01); *A63B 21/068* (2013.01); *A63B 21/4029* (2015.10); *A63B 21/4033* (2015.10); *A63B 21/4034* (2015.10); *A63B 23/1227* (2013.01); *A63B 2208/0238* (2013.01); *A63B 2225/09* (2013.01); *A63B 2225/093* (2013.01)

(58) Field of Classification Search

CPC ..... A63B 21/00047; A63B 21/0005; A63B 21/00054; A63B 21/00087; A63B 21/00094; A63B 21/00178; A63B 21/00185; A63B 21/1453; A63B 21/1457; A63B 21/1465; A63B 1/00; A63B 3/00; A63B 4/00; A63B 2023/006; A63B 23/0205; A63B 23/0216; A63B 23/1227; A63B 23/1236; A63B 21/1469

USPC ..... 74/551.1, 551.3, 551.4, 551.8, 551.9

See application file for complete search history.

(56) References Cited

U.S. PATENT DOCUMENTS

| | | | | |
|---|---|---|---|---|
| 4,332,381 A * | 6/1982 | Lyons | A63B 21/00047 482/140 |
| 4,861,024 A | 8/1989 | Lee | |
| 7,156,788 B1 * | 1/2007 | Jackson | A63B 23/12 248/121 |
| 7,367,928 B2 * | 5/2008 | Storch | A63B 21/00047 482/141 |

(Continued)

*Primary Examiner* — Loan H Thanh
*Assistant Examiner* — Megan Anderson
(74) *Attorney, Agent, or Firm* — Global Intellectual Property Agency, LLC; Daniel Boudwin

(57) ABSTRACT

Described is an exercise device for performing dips. The exercise device includes a pair of L-shaped sections connected to one another such that they form a U-shape. A handlebar section is inserted into a vertical portion of the first L-shaped section, and a footrest section is inserted into a vertical portion of a second L-shaped section. The height of the handlebars and of the footrest section can be adjusted by aligning apertures disposed on the exercise device, and inserting a pin therethrough to secure the device in a desired configuration. Further, the distance between the footrest and handlebars can be adjusted in a similar fashion. Once the device is positioned in the desired configuration, a user can hold a handlebar in each hand and position his or her shoulders above his hands, and the user can place his feet on the footrest in order to perform a dip.

9 Claims, 2 Drawing Sheets

(56) References Cited

U.S. PATENT DOCUMENTS

| | | | | |
|---|---|---|---|---|
| 7,614,986 | B2 * | 11/2009 | Mattox | A63B 21/0004 482/140 |
| 8,388,499 | B1 | 3/2013 | Rindfleisch | |
| 9,302,149 | B1 * | 4/2016 | Parker | A63B 23/0211 |
| 2005/0065000 | A1 | 3/2005 | Reinhart | |
| 2005/0079964 | A1 * | 4/2005 | Francavilla | A63B 23/0233 482/142 |
| 2009/0314127 | A1 * | 12/2009 | Longnecker | B62K 21/125 74/551.9 |
| 2011/0092341 | A1 | 4/2011 | Schneider | |
| 2012/0329620 | A1 | 12/2012 | White et al. | |

* cited by examiner

EXERCISE DEVICE FOR PERFORMING DIPS

CROSS REFERENCE TO RELATED APPLICATION

This application claims the benefit of U.S. Provisional Application No. 61/873,875 filed on Sep. 5, 2013, entitled "The Big Dipper." The above identified patent application is herein incorporated by reference in its entirety to provide continuity of disclosure.

BACKGROUND OF THE INVENTION

Field of the Invention

The present invention relates to exercise equipment and devices. More specifically, the present invention relates to a device adapted to allow a user to perform dips comprising an adjustable, U-shaped frame having a footrest section spaced from a handlebar section. A user can hold a handlebar on each side of his or her body, and can then position his or her feet on the footrest. The handlebar section and footrest sections are elevated above the ground so that the user can lower his or her body towards the ground to perform a dip.

Many individuals perform strength training exercises in order to build muscle and become stronger. Strength training is particularly important for athletes and bodybuilders who need to remain in peak physical condition. During a workout routine, people often perform exercises that target certain muscle groups in order to isolate those muscle groups. However, people may become tired of performing the same exercises, and often try new exercises to challenge themselves and to add variety to their workout routine.

People who exercise on a casual basis may be intimidated by bulky weights and workout equipment and are not confident in their ability to perform exercises properly. Dumbbells may be difficult to use properly, and a person must have the proper form and technique in order to build muscle and avoid injury. Further, many people have difficulty selecting the appropriate weight with which to perform their exercises. Exercise equipment that encourages proper technique is beneficial for people who exercise casually. Further, exercise equipment wherein the user's body weight provides the resistance helps users to avoid injuries resulting from selecting weights that are too heavy.

Dips are a popular exercise that can be performed in order to strengthen the user's triceps, and that also strengthen the user's deltoids and pectoralis muscles. Dips rely on the user's body weight for resistance, and do not require the user to carry or lift heavy weights. While there are several ways to perform a dip, one common method is known as a bench dip. To perform a bench dip, a user may use two work out benches arranged parallel to one another and separated by a space. The user positions his or her hands on the edge of a first bench and beneath his or her shoulders so that the user's arms are fully extended. The user then outstretches his or her legs and positions his or her feet in an elevated position on a second bench, in a starting position. The user then lowers his or her body in a controlled manner until the user's arms are bent at the elbows in roughly a ninety degree angle. The user then lifts his or her body up into the starting position in which the user's arms are substantially straight.

While dips can be performed using a pair of benches, such an arrangement may be inconvenient for a user. The user may not have two benches at his or her disposal, particularly at a busy public gym where many people share exercise equipment. Further, the user may find it awkward to place his or her hands on the edge of a work out bench, and may desire to more firmly grasp the bench. Additionally, the user may wish to position his or her hands in a different orientation, such as a neutral grip wherein the user's palms face his or her body. When using a pair of benches to perform a dip, the user is also unable to adjust the relative height of his or her hands and his or her feet in order to provide more resistance or to alter the mechanics of the exercise.

The present invention relates to an exercise device for performing dips comprising a first L-shaped section adjustably connected to a second L-shaped section such that said first and second L-shaped sections resemble a U-shaped structure. Elongated base members are disposed on the bottom surface of the L-shaped sections in a transverse orientation in order to stabilize the exercise device. A footrest section is provided and comprises a footrest disposed on an elongated post that is adjustably secured within a vertical section of the second L-shaped section. A handlebar section comprises a U-shaped handlebar arranged so that it is parallel to the ground, wherein the handlebars are disposed on an elongated post secured within a vertical section of the first L-shaped section. The heights of the handlebar section and of the footrest section are adjustable by inserting a pin through aligned apertures on the exercise device.

Description of the Prior Art

Devices have been disclosed in the prior art that relate to exercise equipment and apparatuses. These include devices that have been patented and published in patent application publications. These devices generally relate to exercise equipment and apparatuses. The following is a list of devices deemed most relevant to the present disclosure, which are herein described for the purposes of highlighting and differentiating the unique aspects of the present invention, and further highlighting the drawbacks existing in the prior art.

One such prior art device is U.S. Pat. No. 4,861,024 to Lee, which discloses an exercise bench having a frame with a rectangular platform thereon, wherein the platform is divided into a head section and a foot section independently mounted on the frame. The head section comprises a pair of vertically disposed weight supports that may be adapted to receive dip handles thereon. The device may include a removable or fixed leg exercise device. Thus, Lee discloses an exercise device comprising an exercise bench, and does not disclose an exercise device having elevated handle bars and an elevated footrest for aiding a user in performing dips.

U.S. Patent Application Publication No. 2005/0065000 to Reinhart discloses a device for securing weights to a user's waist. The device comprises a core having one or more weight supports thereon, wherein weights can be removably secured on the weight supports. The core can be wrapped around the waist of a user and secured thereon by means of a closure mechanism. The device allows a user to perform weighted leg exercises with less stress placed on the back and abdominal muscles relative to other exercise techniques. Thus, Reinhart discloses an apparatus for holding weights to increase resistance during exercise, and Reinhart fails to disclose an exercise device comprising handlebars and an elevated footrest that allow a user to perform dips.

U.S. Pat. No. 8,388,499 to Rindfleisch discloses an exercise machine having an L-shaped frame with a first portion perpendicular to a second portion. A carriage moves along a path parallel to the first portion and a drive unit is joined to the frame and allows for movement of the carriage. A spool line is variably located on a leverage point on or near the frame, and the spool can be wirelessly controlled. The spool can be adjusted to provide different tensions and to allow for different exercises to be performed. The tension on the spool line is monitored and is displayed on a data monitor. Thus, Lee fails to disclose an exercise device having an elongated post on which handlebars are positioned, and a second elongated post on which a footrest is positioned, wherein the relative heights of the footrest and handlebars can be adjusted.

U.S. Patent Application Publication No. 2011/0092341 to Schneider discloses a weight base having integral handles and a post on which one or more weighted disks can be positioned. The underside of the base has two curved portions such that the base can comfortably be positioned on a user's thighs. The handles allow the user to easily position and move the weight base. The post securely holds weights to provide added resistance for a user performing an exercise such as a push up, wall squat, or other similar exercise. However, the purpose and design of the Schneider device differs from the present invention in that Schneider fails to disclose a device that assists a user in performing a dip. Furthermore, the device disclosed by Schneider does not allow the user to utilize his or her body weight as resistance.

U.S. Patent Application Publication No. 2012/0329620 to White et al. discloses an exercise apparatus comprising a pair of elongated connectors, such as ropes or straps, secured to a pull up bar or similar structure. Two handles can be connected to various portions of the elongated connectors for the user to hold. The elongated connectors comprise unopenable or openable connectors thereon, to which the handles or other attachments can be connected. The device of White, however is limited in that it requires an elevated horizontal bar in which the device may be mounted or attached. Thus, White fails to disclose an exercise device having a rigid frame having handlebars and a footrest thereon to aid a user in performing dips.

These prior art devices have several known drawbacks. Several devices in the prior art are capable of allowing a user to perform dips thereon. However, such devices do not provide handlebars in addition to a footrest on which the user can place his or her feet while performing dips. Thus, the prior art devices do not help a user maintain consistent technique while performing a dip. Further, such devices are not adjustable such that the user to raise or lower the handlebars or the footrest to change the mechanics of the exercise. Other devices in the prior art disclose exercise devices that allow a user to more easily suspend or hang weights from the user's body for added resistance. Instead, the present invention allows a user to perform dips using the user's body weight as resistance, and does not provide a means for suspending additional weights.

In light of the devices disclosed in the prior art, it is submitted that the present invention substantially diverges in design elements from the prior art and consequently it is clear that there is a need in the art for an improvement to existing exercise devices. In this regard the instant invention substantially fulfills these needs.

SUMMARY OF THE INVENTION

In view of the foregoing disadvantages inherent in the known types of exercise devices now present in the prior art, the present invention provides a new exercise device wherein the same can be utilized for providing convenience for the user when performing dips and similar body weight exercises.

It is therefore an object of the present invention to provide a new and improved exercise device that has all of the advantages of the prior art and none of the disadvantages.

It is another object of the present invention to provide an exercise device that facilitates proper positioning of a user's body while performing dips.

Another object of the present invention is to provide an exercise device that is adjustable so as to accommodate to a variety of users and to allow the users to comfortably position the device when performing a dip.

Yet another object of the present invention is to provide an exercise device that has an adjustable footrest and adjustable handlebars that allows a user to change the relative height of his or her hands and feet while performing a dip.

Still another object of the present invention is to provide an exercise device that may be readily fabricated from materials that permit relative economy and are commensurate with durability.

Still another object of the present invention is to provide an exercise device that allows a user to use his or her own body weight to perform dips without requiring the user to carry additional weight.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
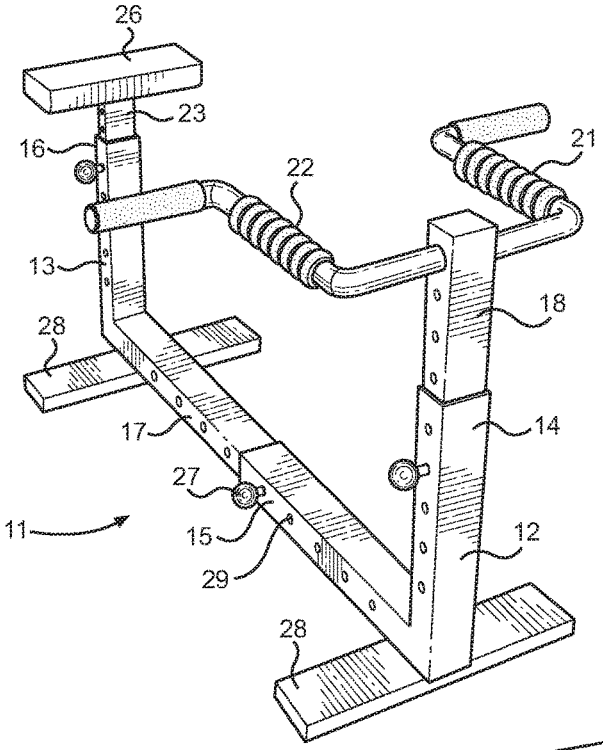
FIG. 1 shows a perspective view of the exercise device of the present invention.

Reference is made herein to the attached drawings. Like reference numerals are used throughout the drawings to depict like or similar elements of the exercise device. For the purposes of presenting a brief and clear description of the present invention, the preferred embodiment will be discussed as used for strength training by performing dips. The figures are intended for representative purposes only and should not be considered to be limiting in any respect.

Referring now to FIG. 1, there is shown a perspective view of the exercise device of the present invention. The exercise device 11 of the present invention comprises a frame having a first L-shaped section 12 adjustably connected to a second L-shaped section 13. Each L-shaped section 12,13 is arranged in an upright position such that a first portion 14,16 of said L-shaped section 12,13 is vertical and is perpendicular to the ground, and a second portion 15,17 of each of said L-shaped section 12,13 is horizontal and parallel to the ground. The horizontal portions of the L-shaped sections 12,13 are adjustably connected via a pin 27, such that the connected L-shaped sections resemble a U-shape. The L-shaped sections 12,13 have a hollow interior so as to reduce the overall weight of the exercise device 11. In preferred embodiments of the present invention, the L-shaped sections 12,13 have rectangular or square cross-sections. One or more elongated base members 28 are secured to a bottom surface of the first and second L-shaped sections 12,13 and are arranged transversely thereon so as to provide support and stability to the exercise device 11, so as to prevent the exercise device 11 from tipping over.

The L-shaped sections 12,13 are adjustably connected to allow the user to increase or decrease the separation between the vertical, first portions 14,16 of the L-shaped sections 12,13. The second portion 17 of the second L-shaped section 13 is inserted into the second portion 15 of the first L-shaped section 12. Thus, the second L-shaped section 13 has a cross-section sized so as to be able to fit into the interior of the first L-shaped section 12. The second portion 17 of the second L-shaped section 13 moves slidably within the second portion 15 of the first L-shaped section 12. The second ends 15,17 of the first and second L-shaped sections 12,13 comprise a plurality of apertures 29 thereon that are evenly spaced at fixed intervals. The user can slide the second L-shaped section 13 to align the apertures 29 thereon with the apertures 29 on the first L-shaped section 12, and can insert a pin 27 through the aligned apertures 29. In this way, the pin 27 secures the L-shaped sections 12,13 together in a particular configuration. In alternate embodiments of the present invention, the arrangement described can be reversed such that the second portion 15 of the first L-shaped section 12 has a cross-section such that it can move slidably within the second portion 17 of the second L-shaped section 13.

A footrest section 23 comprises an elongated post having a footrest 26 disposed on an end thereof. The footrest 26 comprises a widened area on which a user may place both of his or her feet. The footrest 26 preferably comprises a cushion that is soft and flexible so as to provide a user with a comfortable resting surface for his or her feet. The footrest 26 can be comprised of a sponge-like, foam, or rubber material, among others. The cushion can include a protective cover that is water-impermeable to prevent sweat or other liquid from being absorbed into the cushion.

The elongated post of the footrest section 23 is slidably inserted into the first portion 16 of the second L-shaped section 13. The footrest section 23 has a smaller cross-section than the first portion 16 of the second L-shaped section 13 such that the footrest section 23 can be inserted therein. The footrest section 23, similar to the L-shaped sections 12,13, has a rectangular or square cross-section and a hollow interior. Further, the footrest section 23 comprises a plurality of apertures thereon that align with apertures on the first portion 16 of the second L-shaped section 13. The footrest section 23 can be elevated or lowered as desired, and the apertures can be aligned. Once aligned, a pin 27 can be inserted through the apertures in order to maintain the footrest 26 at a particular height.

The handlebar section 18 of the present invention comprises an elongated post having a pair of handlebars 21,22 disposed on an end thereof. The handlebars 21,22 may be integrally formed with the handlebar section 18, or may be secured thereto by suitable fastening means such as welding. Alternatively, the handlebars 21,22 may be removably secured to the handlebar section 18. The handlebars 21,22 are substantially parallel to the ground and extend from the handlebar section 18 towards the footrest section 23. Each handlebar comprises an L-shape that is attached to the handlebar section 18, such that together the handlebars 21,22 resemble a U-shape. The handlebars 21,22 are positioned such that a user can hold a handlebar 21,22 on each side of his or her body. The handlebars 21,22 may have padding thereon so as to provide a user with an easily grasped, and comfortable gripping surface. Additionally, the padding prevents the handles from slipping due to the perspiration on the user's hands while exercising. The padding can comprise a tubular padded member that is slidably positioned on the handlebars 21,22.

The handlebar section 18 is slidably positioned within the first portion 14 of the first L-shaped section 12. The handlebar section 18 has a smaller cross-section than the first portion 14 of the first L-shaped section 12 so that the handlebar section 18 can be inserted therein. The handlebar section 18, similar to the L-shaped sections 12,13, has a substantially rectangular or square cross-section and a hollow interior. Further, the handlebar section 18 comprises a plurality of apertures thereon that align with apertures on the first portion 14 of the first L-shaped section 12. The handlebar section 18 can be elevated or lowered as desired, and the apertures can be aligned. Once aligned, a pin 27 can be inserted through the apertures in order to maintain the handlebars 21,22 at a particular height.

Figure 2:
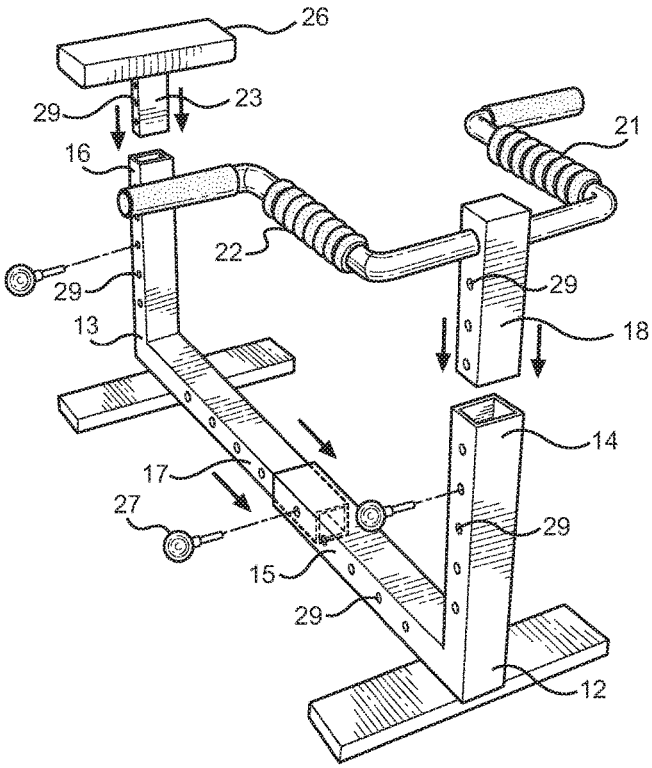
FIG. 2 shows a perspective view of the adjustable sections of the exercise device of the present invention.

Referring now to FIG. 2, there is shown a perspective view of the adjustable portions of the present invention. The present invention provides the user with flexibility in configuring the exercise device to suit each user's preferences. The footrest section 23 comprises an elongated post with a plurality of apertures 29 thereon that align with the apertures 29 on the first portion 16 of the second L-shaped section 13 when the footrest section 23 is inserted therein. The apertures 29 may be positioned only on one side of the exercise device 11, or the apertures 29 may be on opposing sides of the exercise device 11 so that a pin 27 can extend entirely through the footrest section 23 and the second L-shaped section 13.

The user may slide the footrest section 23 upward or downward within the vertical, first portion 16 of the second L-shaped section 13. Once the user has positioned the footrest 26 at the desired height, the user can align the apertures 29 and insert a pin 27 therethrough, so as to secure the footrest section 23 to the first portion 16 of the second L-shaped section 13. The pin 27 comprises an elongated member having a stopper at one end. The stopper prevents the pin 27 from being completely inserted, and thus stuck or lost, within the interior of the L-shaped sections. Further, the stopper is easy for a user to grasp so that the user can conveniently adjust the exercise device.

The handlebar section 18 can be adjusted in a similar fashion to the footrest section 23. The elongated post of the handlebar section 18 comprises a plurality of apertures 29 thereon that align with apertures 29 on the first portion 14 of the first L-shaped section 12 when the handlebar section 18 is inserted therein. Once the user adjusts the handlebars 21,22 to the desired height, the user can secure the handlebar section 18 to the first portion 14 of the L-shaped section 12 by inserting a pin 27 through the aligned apertures 29.

Additionally, the user may adjust the length of the exercise device 11, corresponding to the separation between the footrest 26 and handlebars 21,22. For example, a taller user may wish to have a greater separation between the footrest 26 and handlebars 21,22 than would a shorter user. Similar to the adjustability of the footrest section 23 and the handlebar section 18, a second portion 17 of the second L-shaped section 13 can be slidably inserted into the second portion 15 of the first L-shaped section 12. A plurality of apertures 29 are positioned on the second portion 15,17 of each L-shaped section, and the apertures 29 can be aligned so that the user can insert a pin 27 therethrough in order to secure the first and second L-shaped sections 12,13 together.

Figure 3:
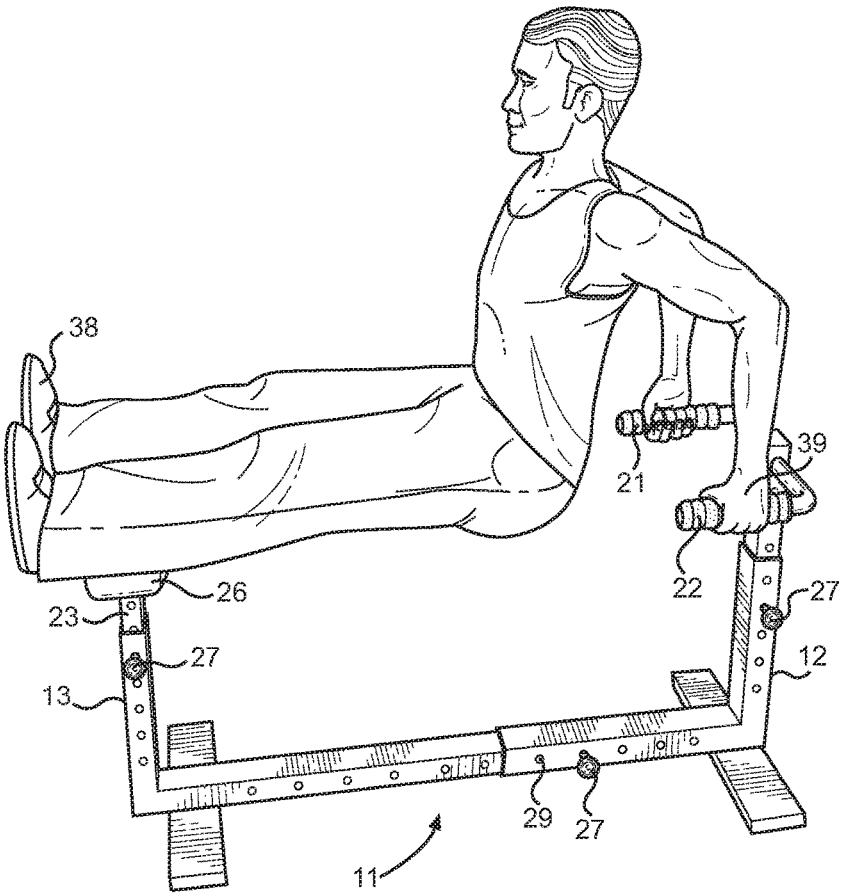
FIG. 3 shows a perspective view of the exercise device of the present invention as used to perform a dip.

Referring now to FIG. 3, there is shown a perspective view of the exercise device of the present invention in use. The user can adjust the exercise device 11 to the desired length, and can adjust the handlebar section to the desired height, and can adjust the footrest section 23 to the desired height. This is accomplished by aligning the apertures 29 on the respective portions of the exercise device 11, and inserting a pin 27 therethrough. Once the exercise device 11 is configured in the desired orientation, the user may grasp a handlebar 21,22 in each hand 39. The user holds the handlebars 21,22 such that his or her shoulders are positioned directly above his or her hands 39. The user can then lift his or her feet 38 and position them on the footrest 26, so that the user's legs are outstretched, and are substantially straight. In the starting position, the user's arms are substantially straight. The user then lowers his or her body using his or her arms until his or her arms are roughly parallel to the ground, such that the elbow is bent at a ninety degree angle. Thus, the user's torso will lower or dip towards the ground. The user can then straighten his or her arms to return to the starting position.

The handlebars 21,22 facilitate proper hand 39 placement so that the user can perform dips in the same manner each time the user utilizes the present invention. Further, the handlebars 21,22 provide the user with a firm grip, in contrast to the user simply resting his or her hands on a work-out bench. Thus, the present invention encourages the user to employ proper technique when performing a dip.

Figure 4:
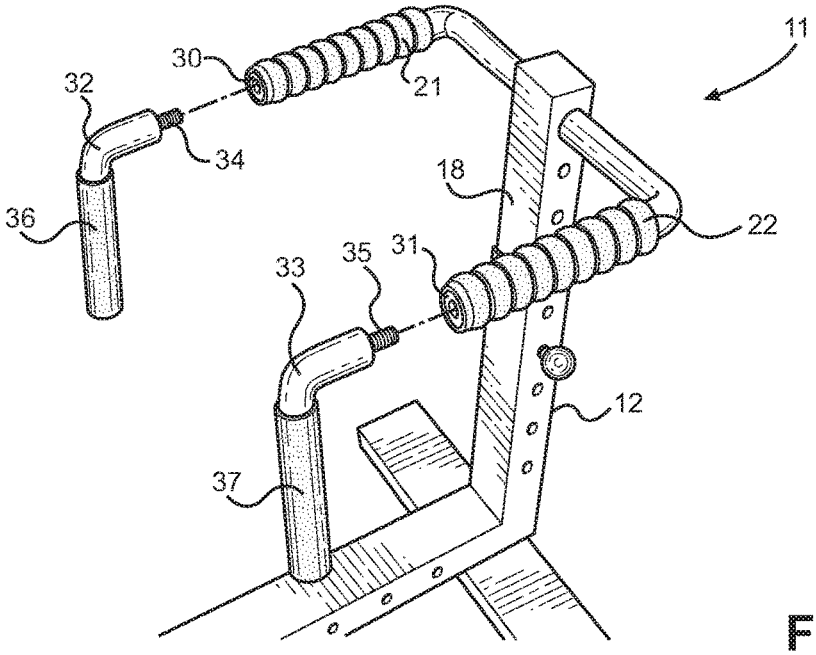
FIG. 4 shows a close-up view of the handlebars of the present invention.

Referring now to FIG. 4, there is shown a perspective view of the handlebars of the present invention. The handlebars 21,22 are positioned substantially perpendicularly to the elongated post of the handlebar section 18. The handlebars 21,22 extend towards the footrest 26 of the exercise device 11. Further, the handlebars 21,22 are substantially parallel to the ground. The handlebars 21,22 comprise a U-shape so that the user will perform a dip with his or her hands positioned in a neutral grip, wherein the user's palms are facing towards the user's body.

The present invention further provides handlebar extensions 32,33 that can be engaged with the free ends 30,31 of the handlebars 21,22. The free ends 30,31 of the handlebars 21,22 have apertures therethrough with a threaded interior. The apertures are adapted to receive the threaded end 34,35 of a handlebar extension 32,33. The handlebar extensions 32,33 comprise an L-shaped handle having a threaded end 34,35 on one end, and a cushioned grip 36,37 on the other end. The user can simply screw the threaded end 34,35 of the handlebar extension 32,33 into the aperture in the free end 30,31 of the handlebars 21,22. Once secured, the handlebar extensions 32,33 extend in opposing directions apart from one another and outward from the exercise device 11. In this way, the handlebar extensions 32,33 allow a user to perform a dip with an overhand grip, and allows a user to have a wider hand positioning if so desired.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise device for performing dips, comprising:

a first L-shaped section having a first portion arranged vertically, and a second portion arranged horizontally;

a second L-shaped section having a first portion arranged vertically, and a second portion arranged horizontally;

wherein said second portion of said first L-shaped section is adjustably secured to said second portion of said second L-shaped section;

a first elongated post having a first end adjustably secured within the first portion of said second L-shaped section, and a second end on which a footrest is disposed;

a second elongated post having opposing sides and a first end adjustably secured within the first portion of said first L-shaped section, and a second end;

a pair of handlebars each disposed on one of the opposing sides of the second end of the second elongated post, each of the pair of handlebars comprising:

a first bar member joined to a second bar member;

the first bar member oriented parallel to the second portion of the second L-shaped section; and the second bar member oriented perpendicular to the second portion of the second L-shaped section;

wherein each of said first bar members comprise a threaded opening adapted to receive said second bar member therein; each of said second bar members comprise an L-shape wherein a first end of said second bar member includes threading for attachment to said threaded opening on each of said pair of handlebars, and wherein a second end of each of the second bar members comprises padding thereon; each of said second bar members extending from the first bar member in opposing directions.

2. The exercise device of claim 1, wherein said second portion of said second L-shaped section comprises a plurality of apertures;

wherein said second portion of said first L-shaped section comprises a plurality of apertures;

wherein said apertures on said first L-shaped section can be aligned with said apertures on said second L-shaped section;

wherein a pin is inserted through said apertures to removably secure said first L-shaped section to said second L-shaped section.

3. The exercise device of claim 1, wherein said footrest comprises a cushion.

4. The exercise device of claim 1, wherein said pair of handlebars comprise a U-shape.

5. The exercise device of claim 1, wherein said pair of handlebars comprise padding thereon.

6. The exercise device of claim 1, wherein said pair of handlebars are arranged such that they are parallel to the ground and extend toward said footrest.

7. The exercise device of claim 1, wherein said second portion of said first L-shaped section and said second portion of said second L-shaped section each comprise an elongated base arranged transversely on a bottom surface thereof.

8. The exercise device of claim 1, wherein said first portion of said first L-shaped section comprises a plurality of apertures thereon;

wherein said elongated post comprises a plurality of apertures thereon;

wherein said elongated post can be adjustably secured to said first L-shaped section by aligning an aperture on said first portion of said first L-shaped section with an aperture on said elongated post, and inserting a pin therethrough.

9. The exercise device of claim 1, wherein said first portion of said second L-shaped section comprises a plurality of apertures thereon;

wherein said footrest section comprises a plurality of apertures thereon;

wherein said first end of said footrest section is adapted to be inserted within said first portion of said second L-shaped section;

wherein said footrest section can be adjustably secured to said second L-shaped section by aligning an aperture on said second L-shaped section with an apertures on said footrest section and inserting a pin therethrough.

* * * * *